US006267162B1

(12) United States Patent
Wilske

(10) Patent No.: US 6,267,162 B1
(45) Date of Patent: Jul. 31, 2001

(54) MORTISING TOOL

(76) Inventor: Paul F. Wilske, 4400 Ridgelane Dr., High Ridge, MO (US) 63049

( * ) Notice: Subject to any disclaimer, the term of this patent is extended or adjusted under 35 U.S.C. 154(b) by 0 days.

(21) Appl. No.: 09/542,265

(22) Filed: Apr. 4, 2000

(51) Int. Cl.[7] ..... B27M 3/34

(52) U.S. Cl. ..... 144/27; 33/197; 30/197.1; 144/75

(58) Field of Search ..... 144/27, 75; 33/197; 30/167.1, 167.2

(56) References Cited

U.S. PATENT DOCUMENTS

| | | | |
|---|---|---|---|
| 302,058 | | 7/1884 | Thurston . |
| 453,045 | | 5/1891 | Gutzman . |
| 507,914 | | 10/1893 | Lee . |
| 724,966 | | 4/1903 | Strubel . |
| 761,861 | | 6/1904 | Wagner . |
| 768,058 | | 8/1904 | Mackenzie . |
| 1,043,584 | | 11/1912 | Franklin . |
| 1,251,693 | | 1/1918 | Pummill . |
| 1,295,386 | | 2/1919 | Thompson . |
| 1,417,431 | | 5/1922 | Vogt . |
| 1,430,874 | | 10/1922 | Anderson . |
| 1,754,925 | | 4/1930 | Almind . |
| 1,879,454 | * | 9/1932 | Parker ..... 144/27 |
| 2,440,208 | | 4/1948 | Parcell . |
| 2,500,800 | | 3/1950 | Carlson . |
| 2,717,618 | | 9/1955 | Polkosnik . |
| 2,794,460 | | 6/1957 | Grathwol . |
| 2,794,461 | | 6/1957 | Kozlowski . |
| 2,804,106 | | 8/1957 | Dimanno . |
| 3,850,211 | | 11/1974 | Ganier . |
| 4,235,568 | | 11/1980 | Savary . |
| 5,511,312 | | 4/1996 | Hobbs . |

* cited by examiner

*Primary Examiner*—W. Donald Bray
(74) *Attorney, Agent, or Firm*—Greensfelder, Hemker & Gale, P.C.

(57) ABSTRACT

A mortising tool designed to remove a specific quantity of material from a wooden object, such as a door or door jamb, to allow flush mounting of door hinge plates. The tool is comprised of a mortise forming member, a cutting device attached to the lower surface of the mortise forming member, and a longitudinal slot formed through the mortise forming member. The cutting edge of the cutting device and the slot are in alignment. Upon placing the cutting device of the mortising tool to one side of the surface of an object from which a mortise is to be formed, material removal is effected by striking the rear portion of the mortising tool and directing it across the object. Material is removed by the cutting device as the mortising tool is directed across the object, and the slot facilitates waste material removal. The mortising tool is also provided with a shoulder which extends from the lower surface of the mortise forming member for controlling the distance the mortising tool travels when forming a mortise.

18 Claims, 6 Drawing Sheets

MORTISING TOOL

BACKGROUND OF THE INVENTION

The invention generally relates to a mortising tool that permits removal of a specific amount of material, a mortise, from an object. More specifically, this invention permits the formation of a mortise on a hinge-receiving object, such as a door.

SUMMARY OF THE INVENTION

In the field of carpentry, one task which occurs often is the installation of a hinge on a door. Often the door is made of wood and the hinge-receiving edge of the door is a smooth surface out of which a quantity of wood must be removed to provide a space, or mortise, for the placement of the door-mounted portion of the hinge, also known as a hinge plate. In a known art method of providing a mortise on an edge of a door, an outline of the mortise is inscribed, a chisel is used to cut the outline into the door, and a quantity of wood is chiseled out of the door edge within the confines of the outlined scribed area. Moreover, the depth at which the chisel penetrates the edge of the door is difficult to control. As a result, the chiseled out mortise region may have a rough edge and an uneven lower surface. In this respect, it would be desirable for an apparatus to be provided which permits a mortise region for an edge of a door to have a smooth edge and an even, lower surface. The effect of which would result in the installation of a hinge esthetically and properly installed in the mortise.

Throughout the years, a number of inventions have been developed relating to mechanical devices providing mortises on door edges, which do so in a variety of manners. However, all utilize a frame structure that guides a knife that removes a specific quantity of material from the door as it cuts.

Generally, these devices can be classified as those that are secured to the door or to the doorjamb by clamping to the door or doorjamb (see U.S. Pat. Nos. 4,235,268 or 5,511,312), and those that are first secured to the door or to the door jamb by driving a set of knives into the door (see U.S. Pat. Nos. 2,794,461 or 3,850,211). These knives cut the outline of a mortise for a hinge plate, but the knives do not remove material from the door as they cut.

Several different methods disclose a frame for guiding a knife that removes material from a door permitting flush mounting of a hinge plate in a door or doorjamb. In a first method, the frame provides a groove to guide the knife, and also provides threaded engagement with the knife to drive the knife into the door (see U.S. Pat. Nos. 2,794,461 or 5,511,312). In a second method, the frame provides a groove to guide the knife, and also provides guide pins (see U.S. Pat. No. 3,850,211). The guide pins are struck by a hammer or other blunt instrument to drive the knife into the door. In a third method, the frame provides a groove to guide the knife, and also provides a rack and pinion arrangement to drive the knife into the door (see U.S. Pat. No. 2,794,460). In another apparatus, a knife is hingedly connected to the frame, and is pivoted into the door to form a mortise (see U.S. Pat. No. 1,754,925).

All the known mechanical devices disclosed in the prior art that form a mortise to receive a door hinge plate have one thing in common in addition to their intended function; they have moving parts, i.e., blades, with respect to their frames. These complicated devices present an opportunity for lost or damaged parts. It would be desirable to have a manually operated device of rugged, unitary and uncomplicated construction.

Furthermore, it is recognized that electrically-powered devices, such as routers and fixtures utilizing routers exist to produce mortises in doors or door jambs. However, these devices are bulky, expensive, complicated, and require electrical power. It would be desirable to have a small, inexpensive mechanical device that is easy to use, requiring only a blunt instrument, such as a hammer, to form a mortise.

Accordingly, among the several objects, features and advantages of the invention may be noted the provision of a mortising tool comprising a mortise forming member having an upper surface, a lower surface, a leading end and a rearward striking end;

cutting device connected to said lower surface of said mortise forming member and directed toward said leading end of said mortise forming member;

whereby a mortise for receiving a hinge is formed by removing a specific quantity of material from a hinge receiving object such as a door or door frame.

Other objects and features will be apparent or are pointed out in more particular detail hereinbelow.

BRIEF DESCRIPTION OF THE DRAWINGS

Corresponding characters indicate corresponding elements in different views of the drawings.

DETAILED DESCRIPTION OF THE PREFERRED EMBODIMENT

Figure 1:
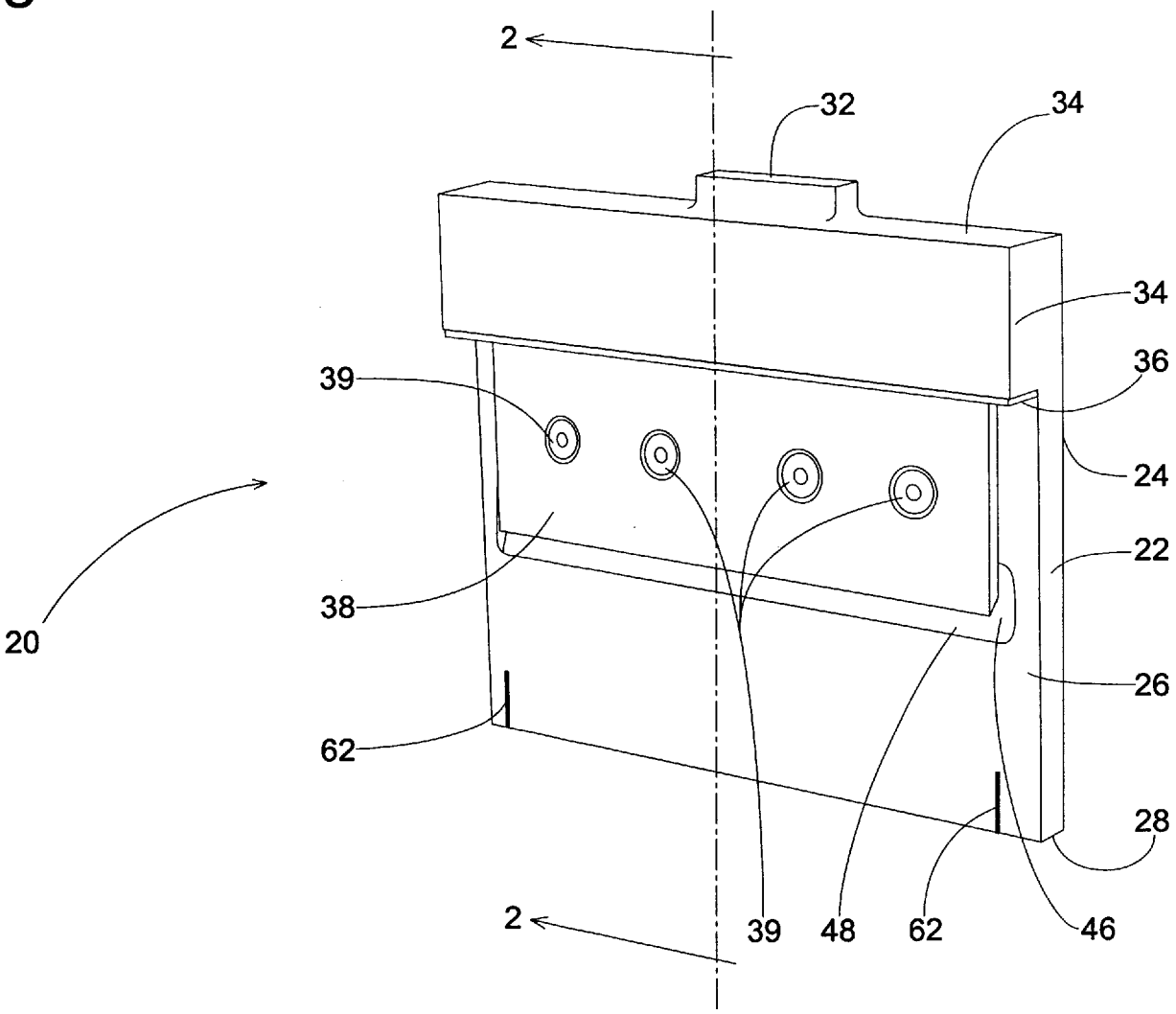
FIG. 1 is a perspective view of a mortising tool constructed in accordance with and embodying the present invention.

Referring to the drawings, FIG. 1 illustrates a perspective view of the preferred form of the invention, wherein 20 generally designates a mortising tool constructed in accordance with and embodying the present invention. Although tool 20 is suitable for forming mortises for a variety of uses, for convenience of this discussion, new mortising tool 20 will be described for the most part in relation to forming a mortise for a hinge-receiving portion of a door. It is understood, particularly in view of the above discussion, that the invention is not to be considered to be limited to such use, but that it is provided only as one especially desirable example. Mortising tool 20 comprises two major components: a mortising forming member 22 and a cutting device 38.

FIG. 1 illustrates that mortise forming member 22 has an upper surface 24, a lower surface 26, a leading end 28 and a rearward striking end 30. Mortising tool 20 also contains a raised target area 32 which extends from striking end 30, preferably located in the middle of striking end 30, whose function will hereinafter be more fully described. Mortising tool 20 additionally has a shoulder 34 extending perpendicularly downward from lower surface 26 of mortise forming member 22, and a resilient material 36 connected to shoulder 34, and at least one pair of alignment inscriptions 62 engraved on the leading end 28 and continuing on upper surface 24 and on lower surface 26, the functions of these elements will be described hereinafter in greater detail.

Figure 2:
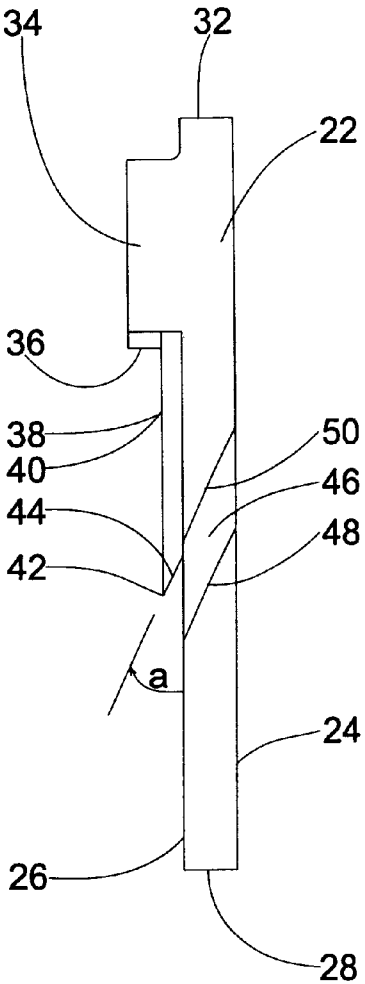
FIG. 2 is a vertical sectional view of the mortising tool from FIG. 1.

FIG. 2 illustrates that cutting device 38 is fixed to lower surface 26 of mortising tool 22, and comprises at least one blade 40, blade 40 having at least one cutting end 42, which has a cutting surface 44. Cutting end 42 is directed toward leading end 28 of mortise forming member 22. Examples of implements which can be used for cutting device 38 include, but are not limited to, a blade, a knife, a razor, or any other mechanical embodiment similarly capable of cutting through door material, typically wood, to form a mortise. Typically, cutting device 38 is fixed to lower surface of mortising tool 22 by at least one fastener 39, selected from the group consisting of bolts, screws, rivets, as well as welds, adhesives or any other similar mechanical embodiment that fixedly attaches cutting device 38 to lower surface 26 of mortising tool 20. Mortise forming member 22 further comprises a longitudinal slot 46 having a leading surface 48 and a rearward surface 50 located in alignment with cutting device 38, the functions of these elements will be described hereinafter in greater detail.

Figure 3:
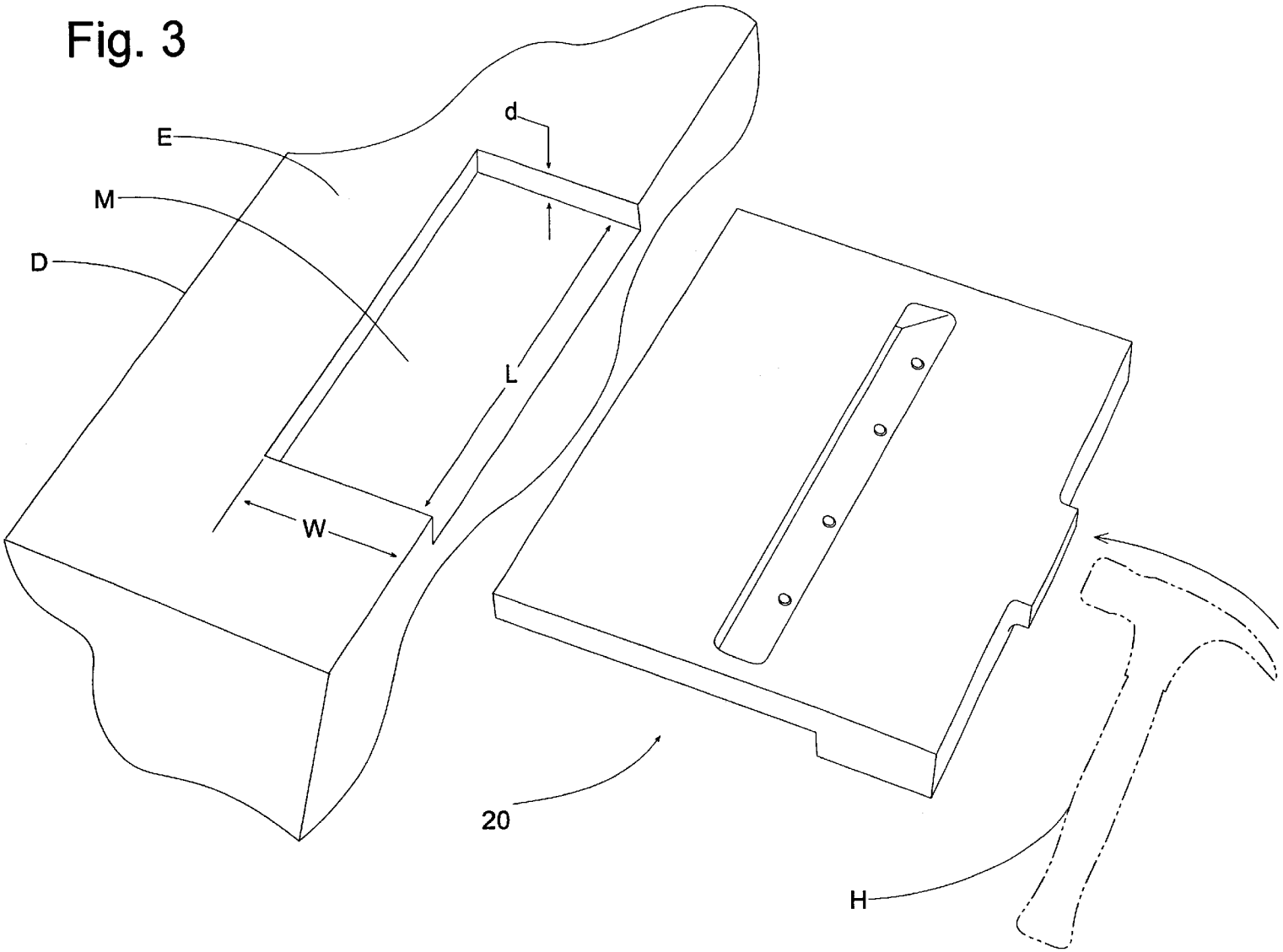
FIG. 3 is a perspective view of the mortising tool from FIG. 1 prior to forming a rectangular mortise M on an edge of a door D.

Referring to FIGS. 1 and 3, the operation of the present invention will be explained in connection with mortise M in door D. The present invention is used only after using a mortise outline forming tool 54, illustrated on FIG. 4, to form a mortise outline. Mortise outline forming tool 54 consists of a generally rectangular-shaped plate having blades extending downwardly from outer edges of the lower surface of the plate, is well known in the art and is commercially available. Positioning the blades of mortise outline forming tool 54 over the marked outline of the mortise to be formed and striking the mortise outline forming tool 54 with a hammer or blunt instrument so that the blades are driven into a door or door jamb, thereby cuts an outline of the mortise into the door or door jamb. After cutting the mortise outline, a person directs mortising tool 20 to the edge E of door D, aligns either alignment inscription 62 with the mortise outline, and places cutting device 38 of the mortising tool 20 in contact with a side of the door D from whose surface a mortise is to be formed. Material removal is effected by striking target area 32 of mortising tool 20 in the direction of the door D with a hammer H or similar blunt instrument. Door material in the form of chips and shavings is removed by cutting device 38 as mortising tool 20 is directed across door D. Slot 46 is used to direct chips and shavings removed by cutting device 38 away from door D. In the preferred embodiment, mortising tool 20 is sized to form a mortise for a door hinge plate. As illustrated in FIG. 3, finished mortise M is defined by dimensions "d", "L" and "w". These dimensions generally relate to conventionally available commercial hinges. Because door hinge plates are available in several sizes, i.e., 3½ and 4 inches, blade 40 can be sized to accommodate these different sizes.

In the preferred embodiment of mortising tool 20, shoulder 34 extends downwardly from lower surface 26 of mortise forming member 22 for controlling the distance mortising tool 20 travels when forming a mortise. As illustrated in FIG. 3, this distance corresponds to a dimension "w" which also represents the width of the hinge plate. Additionally, in the preferred embodiment, resilient material 36, which includes, but is not limited to, rubber, felt, plastic or teflon, is attached or applied to shoulder 34 so that when shoulder 34 contacts door D, resilient material 36 helps dissipate the impact force, to thereby avoid damaging door D.

Referring to FIG. 2, aspects of cutting surface 44 and slot 46 are further explained. Cutting surface 44 is formed with an acute angle "a" measured from leading end 28 of lower surface 26 of mortise forming member 22 toward cutting surface 44, leading and rearward slot surfaces 48 and 50 are in general alignment, preferably in parallel alignment, with cutting surface 44, thereby allowing chips and shavings of door material removed by cutting device 38 to slide along cutting surface 44, upwardly through slot 46 and away from door D. Additionally, experimentation has revealed that when angle "a" measures approximately twenty five degrees, the mortising tool operates most efficiently, although variations of ten degrees in either direction, i.e., fifteen to thirty five degrees, may produce acceptable results. Therefore, it is preferred that cutting angle "a" of cutting surface 44 measure twenty five degrees, with leading and rearward slot surfaces 48 and 50 in general alignment, preferably in parallel alignment, with cutting surface 44. Moreover, it is preferred that rearward slot surface 50 should be coplanar with cutting surface 44.

Figure 4:
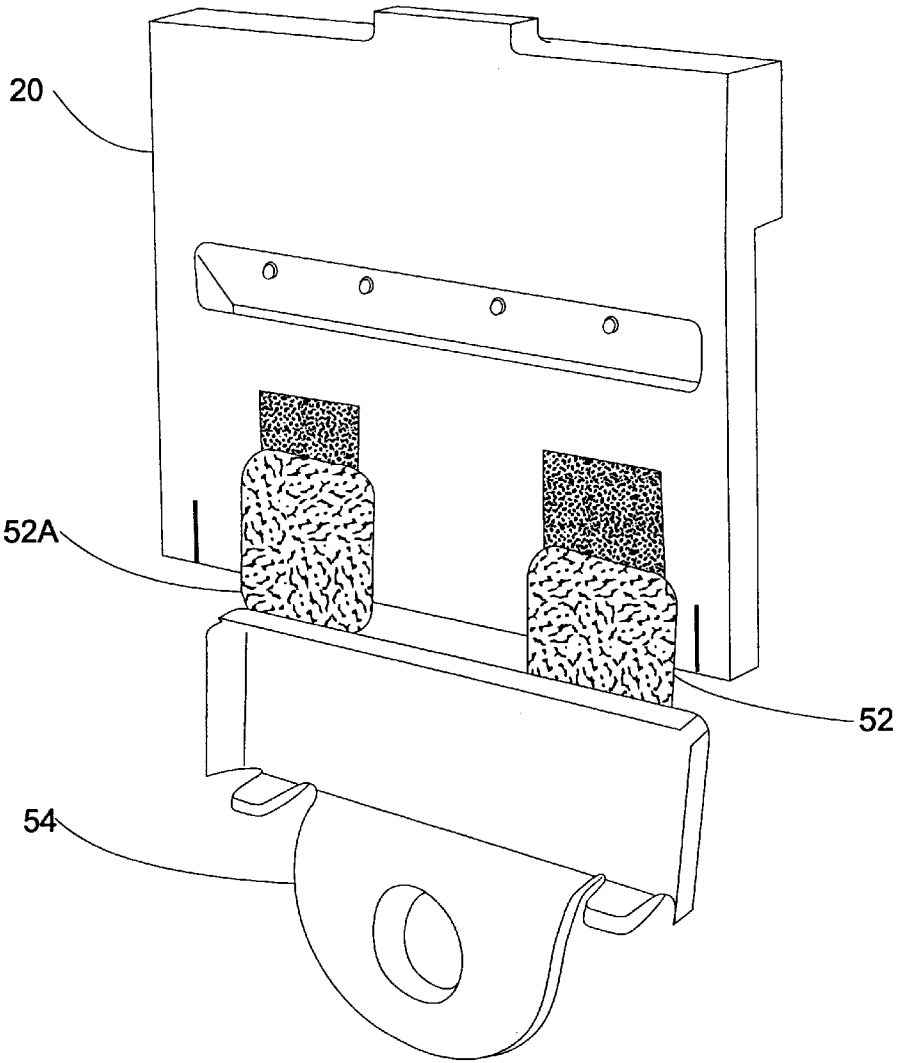
FIG. 4 is a perspective view of a mortising tool connected to a mortise forming outline tool.

FIG. 4 illustrates mortising tool 20 joined to a mortise forming outline tool 54 by connecting straps 52 and 52A. This assembly of mortising tool 20 and mortise outline forming tool 54 represents a complete mortise forming kit 56 to enable one to form mortises. Mortise outline forming tool 54, which consists of a generally rectangular-shaped plate having blades extending downwardly from outer edges of the lower surface of the plate, is well known in the art and is commercially available. Connecting straps 52 and 52A include, but are not limited to, velcro straps, magnets, adhesives, mechanical fastening arrangements such as screws, bolts and slots, quick release pins or any other similar arrangement that keeps mortising tool 20 and mortise cutting outline tool 54 together, but enables quick disassembly to allow each tool to separately perform its respective task.

Mortise forming kit 56, together with a blunt instrument, such as a hammer, represent all that is required to form a mortise, and could be placed in a belt-mounted pouch for easy access and use. After marking the outline of the mortise to be formed in the door or door jamb, mortising tool 20 is separated from mortise outline forming tool 54 by disconnecting connecting straps 52 and 52A. Positioning the blades of mortise outline forming tool 54 over the marked outline of the mortise to be formed and striking the mortise outline forming tool 54 with the hammer or blunt instrument so that the blades are driven into the upper surface or edge of the door or doorjamb, thereby cuts the outline of the mortise into the door or doorjamb. Setting aside mortise forming outline tool 54, select and position mortising tool 20 as previously described above to form a mortise in a door or door jamb. After the mortise is formed, rejoin mortising tool 20 and mortise outline forming tool 54 by reconnecting connecting straps 52 and 52A, thereby reassembling mortise forming kit 56.

Figure 5:
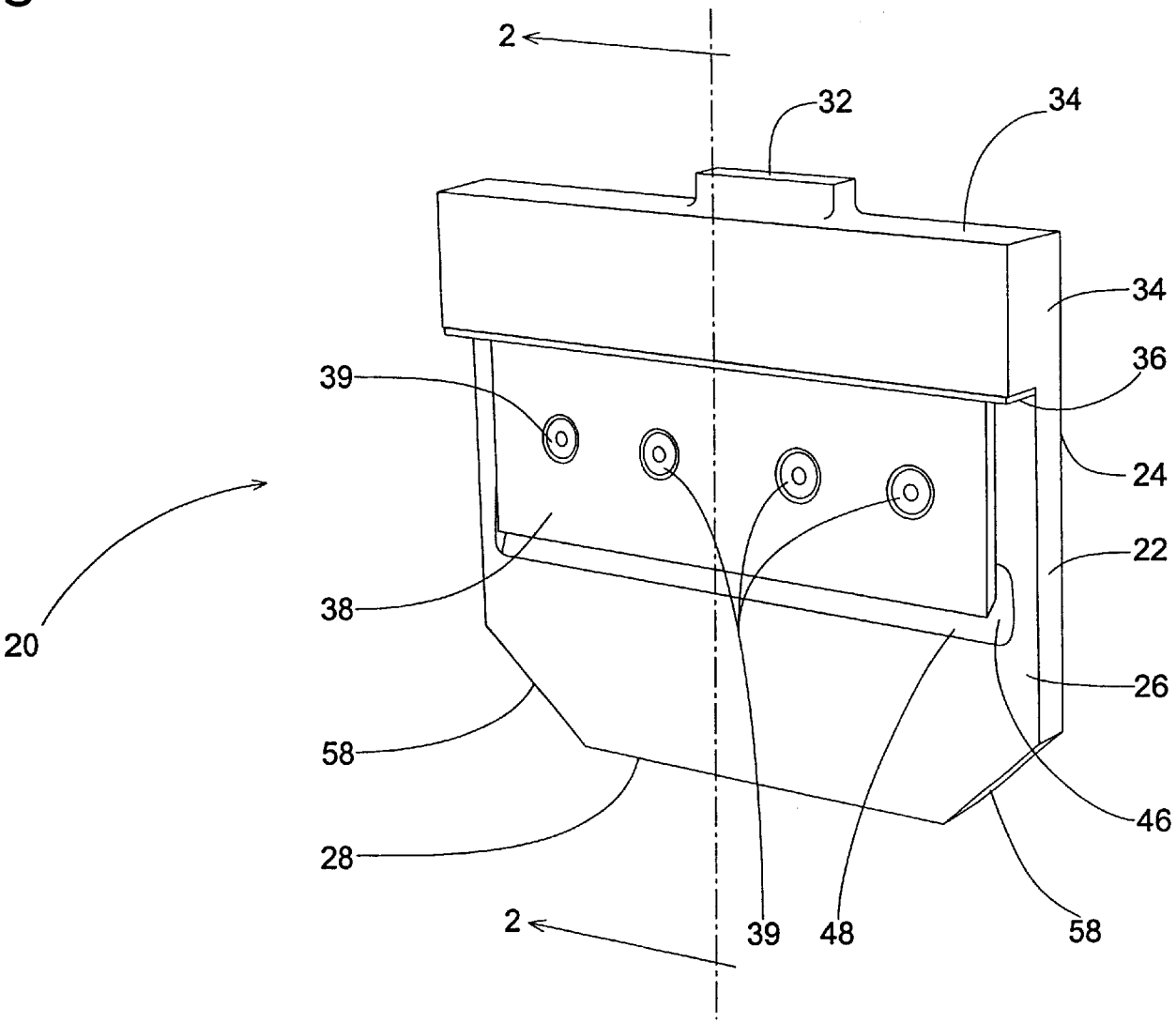
FIG. 5 is a perspective view of an alternate embodiment of a mortising tool.
Figure 6:
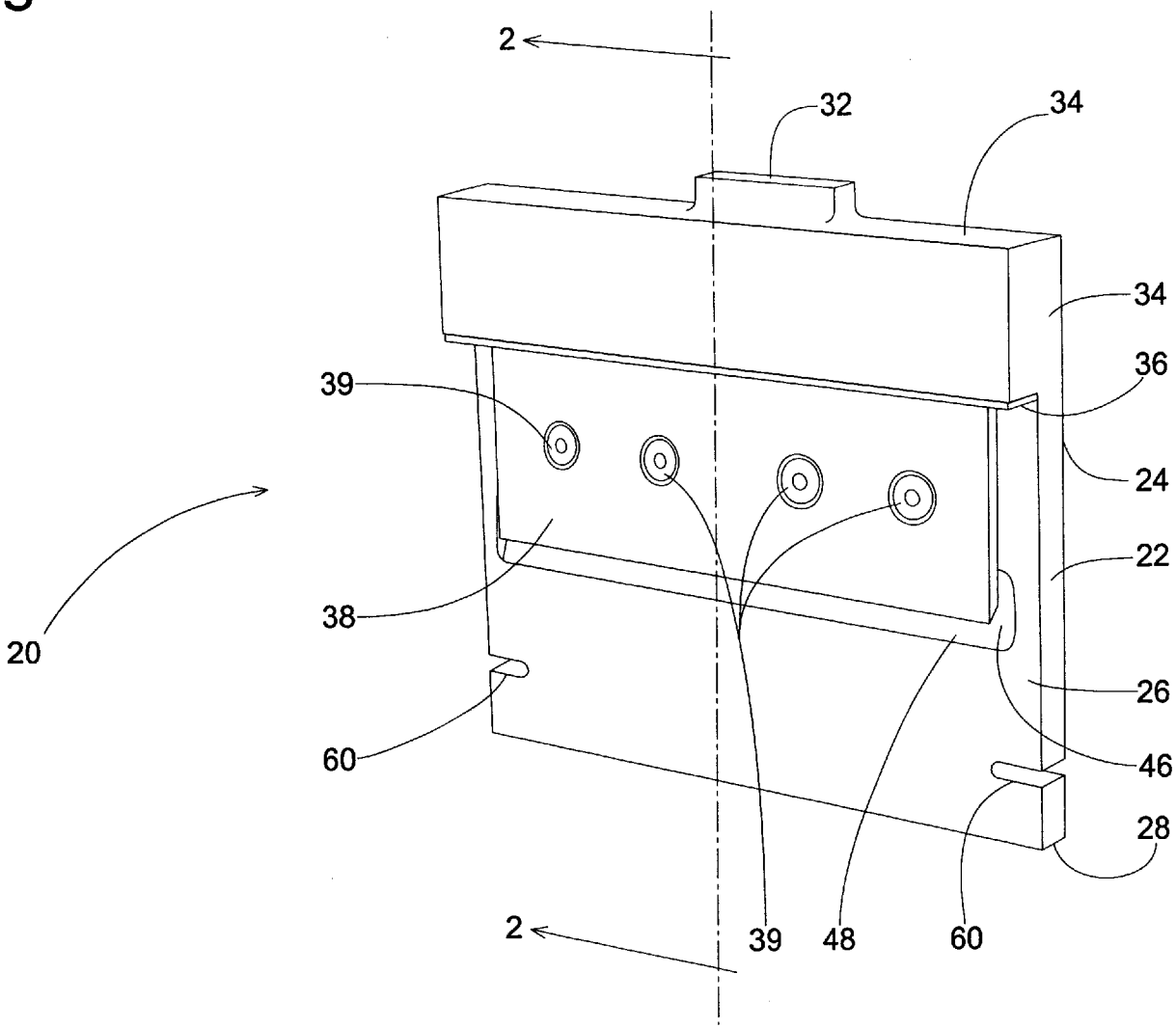
FIG. 6 is a perspective view of an alternate embodiment of a mortising tool.

FIG. 1 illustrates alignment inscriptions 62 which are used to align mortising tool 20 with the mortise outline. FIGS. 5 and 6 illustrate alternate embodiments that can be used to assist alignment of mortising tool 20. FIG. 5 illustrates a pair of alignment chamfers 58 formed from opposing corners of leading end 28 of mortising tool 20, although any similar removal of material representing any geometric configuration that would render the mortise outline visible to more easily facilitate alignment of the mortising tool 20 is included. FIG. 6 illustrates a pair of longitudinal alignment slots 60 formed in opposing sides of mortise forming member between leading end 28 and cutting means cutting end 42, although an aperture of sufficient diameter or any geometric configuration not compromising the structural integrity of mortising tool 20 that renders the mortise outline visible to more easily facilitate alignment of the mortising tool 20 is included. This additionally includes providing sufficient spacing between longitudinal slot leading surface 48 and longitudinal slot rearward surface 50, thereby allowing a person to easily view the mortise outline. Moreover, although any of these features may by themselves be sufficient to assist with mortising tool 20 alignment, any combination of these features may be included in a single embodiment of mortising tool 20.

In an additional embodiment, mortising tool 20 can be formed from a single block of material.

In view of the foregoing description of the present invention and practical embodiments it will be seen that the several objects of the invention are achieved and other advantages are attained. The embodiments and examples were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

The breadth and scope of the present invention should not be limited by any of the above-described exemplary embodiments, but should be defined only in accordance with claims of the application and their equivalents.

What is claimed is:

1. A mortising tool comprising: a mortise forming member having an upper surface, a lower surface, a leading end and a rearward striking end;

cutting device securely connected to said lower surface of said mortise forming member and directed toward said leading end of said mortise forming member;

whereby a mortise for receiving a hinge is formed by removing a specific quantity of material from a hinge receiving object.

2. A mortising tool according to claim 1 wherein said cutting means comprises at least one blade, said blade having at least one cutting end having a cutting surface, wherein said cutting end to be used is directed toward said leading end of said mortise forming member.

3. A mortising tool according to claim 1 further comprising a longitudinal slot having a leading surface and a rearward surface formed in said mortise forming member, said slot being in alignment with said cutting end of cutting means.

4. A mortising tool according to claim 1 further comprising a shoulder extending from said lower surface for controlling the distance said tool travels when forming a mortise.

5. A mortising tool according to claim 3 wherein said cutting surface of said cutting end further comprises an acute angle measured from said leading end of said lower surface of said mortise forming member toward said cutting surface, and said leading and rearward slot surfaces are in alignment with said cutting surface.

6. A mortising tool according to claim 3 wherein said angle of said cutting end is generally twenty five degrees measured from said leading end of said lower surface of said mortise forming member toward said cutting means, and said leading and rearward slot surfaces in alignment with said cutting end.

7. A mortising tool according to claim 1 further comprising at least one fastening means connecting said cutting means to said lower surface of said mortise forming member.

8. A mortising tool according to claim 1 wherein said tool is formed from a single block of material.

9. A mortising tool according to claim 1 wherein said tool is sized to form a mortise for a door hinge plate.

10. A mortising tool according to claim 1 further comprising a target area extending from said striking end.

11. A mortise forming kit comprising a mortising tool each of said mortising tool and said mortise outline forming tool being of unitized construction and a mortise outline forming tool.

12. A mortise forming kit according to claim 11 further comprising connecting means between said tool and said mortise outline forming tool.

13. A mortising tool according to claim 2 further comprising a resilient material applied to said shoulder so that said shoulder does not damage said object.

14. A mortising tool according to claim 6 wherein said cutting surface is coplanar with said rearward slot surface.

15. A mortising tool according to claim 1 further comprising an alignment inscription engraved on said leading end of said mortise forming member and continuing on upper surface and on lower surface of said mortise forming member, said alignment inscription to facilitate alignment of mortising tool.

16. A mortising tool according to claim 1 further comprising a pair of opposing apertures formed in said mortise forming member between said leading end of said mortise member and said cutting means to facilitate alignment of said mortising tool.

17. A mortising tool according to claim 16 wherein said pair of apertures are opposing longitudinal slots.

18. A mortising tool sized to form a mortise for a door hinge plate, having a mortise outline forming tool comprising:

a mortise forming member having an upper surface, a lower surface, a leading end, a rearward striking end and a longitudinal slot having a leading surface and a rearward surface formed in said mortise forming member, a target area extending from said striking end, a shoulder extending from said lower surface for controlling the distance said tool travels when forming a mortise, a resilient material applied to said shoulder so that said shoulder does not damage a hinge receiving object;

a cutting device having at least one blade, said blade having at least one cutting end, wherein said cutting end is directed toward said leading end of said mortise forming member, said cutting device is connected to said lower surface of said mortise forming member, wherein said cutting surface of said cutting end is generally twenty five degrees measured from said leading end of said lower surface of said mortise forming member toward said cutting surface, said angle of said leading and rearward slot surfaces are likewise in alignment with said cutting surface, wherein said rearward slot surface is coplanar with said cutting surface.

* * * * *

UNITED STATES PATENT AND TRADEMARK OFFICE

CERTIFICATE OF CORRECTION

PATENT NO. : 6,267,162 B1
DATED : July 31, 2001
INVENTOR(S) : Wilske et al.

It is certified that error appears in the above-identified patent and that said Letters Patent is hereby corrected as shown below:

Column 5,
Line 39, before "cutting" add -- a --;
Line 54, delete "means" and insert -- device --;

Column 6,
Line 2, delete "means" and insert -- device --;
Line 7, delete "means" and insert -- device --;
Line 36, delete "means" and insert -- device --;
Lines 16-18, delete "each of said mortising tool and said mortise outline forming tool being of unitized construction and a mortise outline forming tool." insert -- and a mortise outline forming tool, each of said mortising tool and said mortise outline forming tool being of unitized construction. --.

Signed and Sealed this

Eleventh Day of June, 2002

*Attest:*

*Attesting Officer*

JAMES E. ROGAN
*Director of the United States Patent and Trademark Office*